US012383786B2

(12) United States Patent
Garufi

(10) Patent No.: US 12,383,786 B2
(45) Date of Patent: Aug. 12, 2025

(54) GRIP DEVICE FOR CABLE-CONNECTED EXERCISE DEVICES

(71) Applicant: Giuseppe Garufi, Deerfield Beach, FL (US)

(72) Inventor: Giuseppe Garufi, Deerfield Beach, FL (US)

( * ) Notice: Subject to any disclaimer, the term of this patent is extended or adjusted under 35 U.S.C. 154(b) by 108 days.

(21) Appl. No.: 18/399,445

(22) Filed: Dec. 28, 2023

(65) Prior Publication Data

US 2024/0226648 A1 Jul. 11, 2024

Related U.S. Application Data

(60) Provisional application No. 63/437,305, filed on Jan. 5, 2023.

(51) Int. Cl.
*A63B 21/00* (2006.01)
*A63B 21/062* (2006.01)

(52) U.S. Cl.
CPC ..... *A63B 21/4035* (2015.10); *A63B 21/151* (2013.01); *A63B 21/4039* (2015.10); *A63B 21/063* (2015.10)

(58) Field of Classification Search
CPC ..... A63B 21/4035; A63B 21/151; A63B 21/4039; A63B 21/063; A63B 21/4043
See application file for complete search history.

(56) References Cited

U.S. PATENT DOCUMENTS 5,090,691 A * 2/1992 Pollock ..... A63B 21/4035 248/693
5,865,146 A * 2/1999 Markham ..... A01K 15/026 119/707
7,137,914 B1 * 11/2006 Boyer ..... A63B 43/007 473/575
7,837,598 B1 * 11/2010 Boozel, Jr. ..... A63B 23/03525 482/38
7,926,451 B2 * 4/2011 Foster ..... A01K 27/003 119/796
8,454,483 B1 * 6/2013 Bradley ..... A63B 21/072 482/44
10,765,904 B1 * 9/2020 Pasterino ..... A63B 21/00043
(Continued)

FOREIGN PATENT DOCUMENTS

GB 2552987 A * 2/2018 ..... A63B 21/4013

*Primary Examiner* — Sundhara M Ganesan
(74) *Attorney, Agent, or Firm* — Melvin K. Silverman

(57) ABSTRACT

An exercise grip device is disclosed having a main body formed from two detachable hemispheres, wherein said two detachable hemispheres comprise an upper hemisphere and a lower hemisphere. The main body of the exercise grip device forms a rounded shape. The exercise grip device further comprises an internal cavity in said main body with an upper vertical channel connecting said internal cavity through the upper hemisphere to an exterior area. A horizontal channel is included, recessing from an outer surface of said upper hemisphere to an opposite outer surface of said upper hemisphere. The horizontal channel extends through the upper hemisphere. The exercise grip device also includes a retaining ring removably disposed in said internal cavity. The retaining ring vertically extends upward in said upper vertical channel. A removable securement pin is included, extending through the horizontal channel and through the retaining ring.

9 Claims, 7 Drawing Sheets

(56) References Cited

U.S. PATENT DOCUMENTS 10,850,149 B1 * 12/2020 Baldwin ..... A63B 21/4035
11,911,651 B1 * 2/2024 Adams ..... G06F 3/014
11,911,657 B1 * 2/2024 KashKash ..... A63B 21/0628
12,005,288 B1 * 6/2024 Carroll ..... A63B 23/03508
2004/0048724 A1 * 3/2004 Wang ..... A63B 43/02 482/109
2006/0035751 A1 * 2/2006 Blair ..... A63B 21/4017 482/44
2006/0111221 A1 * 5/2006 Williams ..... A63B 21/4017 482/93
2007/0254788 A1 * 11/2007 Nam ..... A63B 21/4035 482/140
2008/0242508 A1 * 10/2008 Smith ..... A63B 21/4035 74/5.22
2010/0113234 A1 * 5/2010 Kristiansen ..... A63B 21/4035 482/139
2012/0309595 A1 * 12/2012 Dike ..... A63B 21/4034 482/106
2012/0329610 A1 * 12/2012 White ..... A63B 21/4035 482/44
2013/0035220 A1 * 2/2013 Adams ..... A63B 21/4035 482/129
2013/0059701 A1 * 3/2013 Santa Cruz ..... A63B 21/072 482/108
2013/0065740 A1 * 3/2013 Francis ..... A63B 21/0435 482/122
2014/0141943 A1 * 5/2014 DiPace ..... A63B 21/0557 482/93
2014/0200499 A1 * 7/2014 Champion ..... A63B 21/4009 602/36
2014/0329650 A1 * 11/2014 Watry ..... A63B 69/0093 482/139
2016/0038793 A1 * 2/2016 Kikel ..... A63B 23/16 482/121
2016/0220863 A1 * 8/2016 Braier ..... A63B 23/16
2016/0243396 A1 * 8/2016 Taylor ..... G09B 19/0038
2016/0346589 A1 * 12/2016 Emick ..... A63B 21/0628
2017/0136283 A1 * 5/2017 Sorin ..... A63B 21/4035
2017/0296860 A1 * 10/2017 Watry ..... A63B 21/4035
2017/0361159 A1 * 12/2017 Malcolm ..... A61B 5/1118
2018/0021617 A1 * 1/2018 Krull ..... A63B 21/023 482/128
2018/0043213 A1 * 2/2018 Poeschl ..... A63B 26/00
2018/0085616 A1 * 3/2018 Makiyama ..... A63B 21/4035
2018/0126208 A1 * 5/2018 Davis ..... A63B 21/16
2018/0178049 A1 * 6/2018 Marquez ..... A63B 21/4039
2018/0280756 A1 * 10/2018 Nakashima ..... A63B 21/4035
2019/0105528 A1 * 4/2019 Bardakci ..... A63B 23/14
2019/0299049 A1 * 10/2019 Parsian ..... A63B 23/1209
2020/0047019 A1 * 2/2020 Meyer ..... A63B 21/0557
2021/0008410 A1 * 1/2021 Athanasiou ..... A63B 21/4019
2021/0016131 A1 * 1/2021 Hunt ..... A63B 21/0604
2021/0178219 A1 * 6/2021 Negron ..... A63B 22/0046
2021/0322821 A1 * 10/2021 Mittig ..... A63B 23/02
2022/0008778 A1 * 1/2022 Gur Arie ..... A63B 21/068
2022/0176185 A1 * 6/2022 Booker ..... A63B 21/4033
2022/0409948 A1 * 12/2022 Nicholas ..... A63B 21/0724
2023/0076880 A1 * 3/2023 Malcolm ..... A63B 21/4035
2023/0103853 A1 * 4/2023 Bui ..... A63B 21/4043 482/148
2023/0191183 A1 * 6/2023 Kofron ..... A63B 21/0004 482/110
2023/0330473 A1 * 10/2023 Fletcher ..... A63B 21/151
2024/0390728 A1 * 11/2024 Hara ..... A63B 21/151
2024/0416175 A1 * 12/2024 Mickolio ..... A63B 21/4033
2025/0135266 A1 * 5/2025 Simon ..... A63B 21/072

* cited by examiner

GRIP DEVICE FOR CABLE-CONNECTED EXERCISE DEVICES

CROSS-REFERENCE TO RELATED APPLICATIONS

This application claims priority under 35 U.S.C. § 119(e) of U.S. Provisional Patent Application Ser. No. 63/437,305, filed Jan. 5, 2023, and entitled "GRIP DEVICE FOR WEIGHTED CABLE EXERCISE DEVICES", which in hereby incorporated in its entirety by reference.

FIELD OF THE INVENTION

The present invention relates to exercise equipment. More specifically, the following relates to a grip device for weight training, particularly cable-based machines and equipment, and cable-based weight machines.

BACKGROUND

Weighted cable devices are common in most gyms and fitness clubs and are provided with a number of weight stacks which allow for different levels of weight to be selected by moving a locking pin. This locking pin is connected in a manner that a cable can pull it, and through various pulleys, the other end has a grip device for the cable. Gyms will often have a selection of grip devices which are available for use by many different people, which can lead to an undesirable scenario of the available grip devices carrying various germs and bacteria from many different people.

Furthermore, the grip selections commonly available at gyms are often not user customizable and may be of an undesirable sub-optimal grip configuration.

Current grip elements include bars that can include handles, ankle straps, and various bars, such as straight bars, lap bars, and curl bars, among others. Typically, these attachments have a cushioned handle area where a user grips onto, which may be both unergonomic and unsanitary, as many people may use the bars and the foam cushions can trap bacteria. Further, if no cushion is available, user's may end up with blisters if they are not careful about their grip on a metal bar.

Thus, a need exists in the market for a removable ball grip device capable of withstanding pulling force created by weights or tension created by workout equipment a user is engaged with.

SUMMARY OF THE INVENTION

The invention disclosed herein provides an exercise grip device. The exercise grip device comprises a main body formed from two detachable hemispheres, wherein said two detachable hemispheres comprise an upper hemisphere and a lower hemisphere. The main body of the exercise grip device forms a rounded shape. The exercise grip device further comprises an internal cavity in said main body with an upper vertical channel connecting said internal cavity through said upper hemisphere to an exterior area. Yet further provided in the exercise grip device is a horizontal channel recessing from an outer surface of said upper hemisphere to an opposite outer surface of said upper hemisphere, wherein said horizontal channel extends through said upper hemisphere. The exercise grip device also includes a retaining ring removably disposed in said internal cavity, wherein said retaining ring vertically extends upward in said upper vertical channel. Finally, the exercise grip device provides a removable securement pin extending through said horizontal channel and through said retaining ring.

It is an object of the present invention to provide a user customizable grip.

It is yet another object of the present invention is to provide a compact grip device that can be easily carried to and from a gym or fitness facility.

It is a further object to provide a grip that is easily connectable to commonly available weighted cable machines.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete, and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
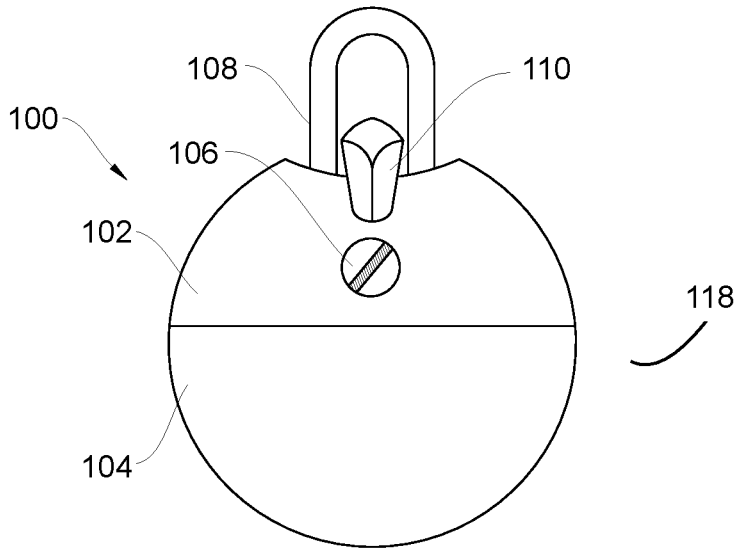
FIG. 1 illustrates a side view of an exercise grip device.

The invention herein provides a grip element for exercise machinery and equipment that solves the problems above with current exercise handles and bars.

As stated above, weighted cable devices are common in most gyms and fitness clubs and are provided with a number of weight stacks which allow for different levels of weight to be selected by moving a locking pin. This locking pin is connected in a manner that a cable can pull it, and through various pulleys, the other end has a grip device for the cable. Gyms will often have a selection of grip devices which are available for use by many different people, which can lead to an undesirable scenario of the available grip devices carrying various germs and bacteria from many different people.

The grip selections commonly available at gyms are often not user customizable and may be of an undesirable sub-optimal grip configuration.

Current grip elements include bars that can include handles, ankle straps, and various bars, such as straight bars, lap bars, and curl bars, among others. Typically, these attachments have a cushioned handle area where a user grips onto, which may be both unergonomic and unsanitary, as many people may use the bars and the foam cushions can trap bacteria. Further, if no cushion is available, user's may end up with blisters if they are not careful about their grip on a metal bar.

Traditional grips, whether on weights or cable machines, can sometimes strain the wrists, hands, or forearms due to their rigid and linear design. An ergonomic ball, with its spherical shape, can adapt better to the natural curvature of the hand, reducing strain and enhancing comfort. Further, traditional grip training often relies on tools like grippers or bar grips.

The current invention solves these problems by providing a removable ball grip device capable of withstanding pulling force created by weights or tension created by workout equipment a user is engaged with. An ergonomic ball offers a more dynamic and varied form of grip training, beneficial for sports and activities where grip strength and control are crucial.

The ball can be designed with different textures, sizes, and materials to cater to various preferences and needs. This customization can make it a versatile tool for a wide audience, from athletes to the elderly. These different deigns and textures may be interchanged to the preference of the user. Both the top and bottom, also known as the first half and second half, are interchangeable, allowing for a uniquely customizable experience.

Using a ball grip requires more muscle activation in the hands, forearms, and even the upper arms. This is due to the need for greater stabilization and control, as the round shape doesn't allow for a static grip like a bar or handle. Gripping a ball requires more intricate muscle coordination, which can enhance neural connections between the hands and the brain. This is beneficial not just for physical strength but also for motor skills.

This type of grip can be used in various exercises, potentially replacing traditional handles or even dumbbells. It adds a new dimension to cable machine exercises, free weight exercises, and even bodyweight movements. In physical therapy and rehabilitation, an ergonomic ball can be used to improve grip strength, coordination, and dexterity. It may also be useful in recovery exercises post-injury or surgery, especially in the hands, wrists, and arms.

Further, for people with joint issues or arthritis, a ball grip is safer and more comfortable, reducing the risk of exacerbating these conditions. This makes exercise more accessible to a broader range of individuals.

The grip device for cable-connected exercise devices of the present invention may be used to provide a user customizable grip, provide a compact grip device that can be easily carried to and from a gym or fitness facility, and provide a grip that is easily connectable to commonly available weighted cable machines. This apparatus and system are particularly shown in FIGS. 1-9D.

Figure 2:
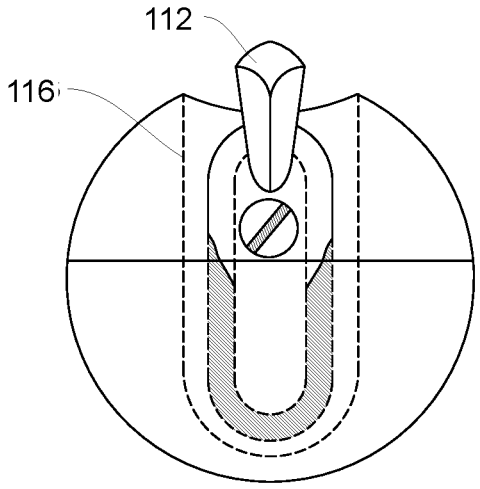
FIG. 2 illustrates a side view of the exercise grip device, as shown in FIG. 1, with internal cavity shown in phantom containing a connection ring.

FIG. 1 illustrates a side view of an exercise grip device 100. FIG. 2 illustrates a side view of the exercise grip device 100, as shown in FIG. 1, with internal cavity 116 shown in phantom containing a retaining ring 108. The grip device 100 as shown is generally spherical, but can be of different shapes. The device 100 has two halves 102/104, including a first half 102 and a second half 104. In some embodiments, these halves have a rubberized outer surface. The halves 102/104 may be metal covered in rubber, or a rubber like material, for example, the halves 102/104 may also be a plastic/rubber material. When assembled, the two halves 102/104 create an interior channel 116 which is open on one half 102 but does not go through the other half 104 and is thus not a through-hole such that its depth is less than the radius/height of the half 104 whereas the channel 114 portion on the upper half 102 extends all the way through. Within this channel 116 is a retaining ring 108, which is elongated and may be oval in shape. Through this ring 108 is a pin 106 which in some embodiments passes through the upper half 102. The lower half 104 may be removeable from the upper half 102 so that different colors or grip textures/materials or combinations thereof can be selected. Front 112 and rear 110 flaps are provided to keep the ring 108 within the channel 116 or above the channel 116, depending on the desired configuration. The ring 108 can be clipped to a carabiner, such as those shown in FIGS. 5A and 5C, a hook, or other securing device, such as those commonly used in weighted cable exercise devices. When under tension, the retaining ring 108 is pulled out of the channel 116 and is stopped by the pin 106 to bear the weight on the cable. As shown, the depth of the channel 116 is greater than the height of the ring 108 such that the ring can be fully stored within the diameter of the grip device ball 100.

Figure 3:
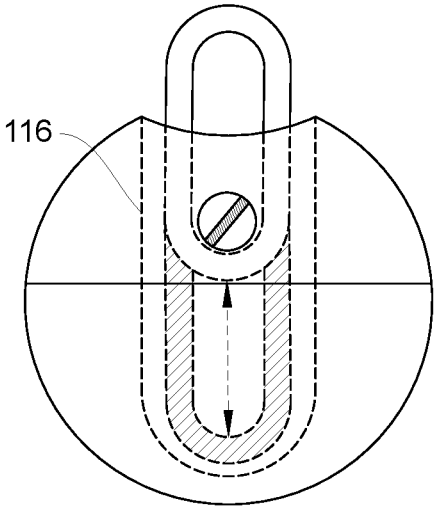
FIG. 3 illustrates a side view of the exercise grip device, as shown in FIG. 1, with internal cavity shown in phantom containing a connection ring with moveable distance shown in hatching.
Figure 4:
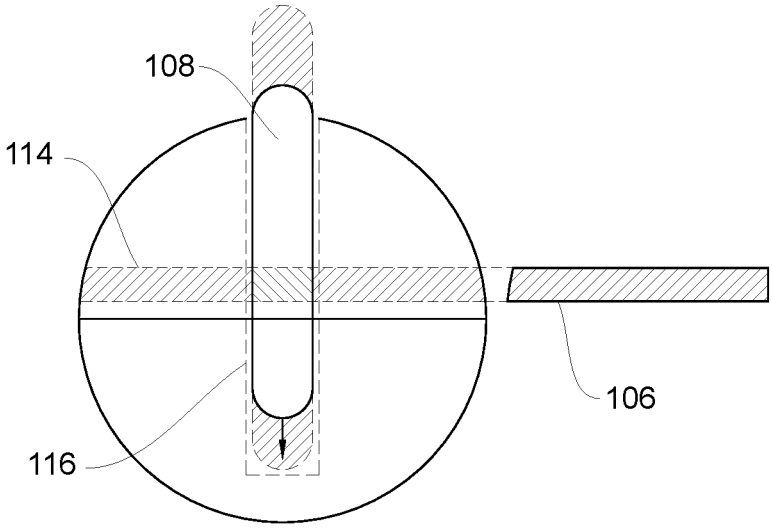
FIG. 4 illustrates an alternative side view of the grip device, as shown in FIG. 3, with moveable distance shown in hatching.

FIG. 3 illustrates a side view of the exercise grip device 100, with internal cavity 116 shown in phantom containing a connection ring 108 with moveable distance shown in hatching. FIG. 3 shows additional details on how the ring 108 moves, depending on if it is loaded or not. The embodiments shown in FIGS. 3 and 4 do not include the flaps installed. FIG. 4 illustrates an alternative side view of the grip device 100, with moveable distance shown in hatching. FIG. 4 shows additional details on the through pin 106. In some embodiments, as shown, the pin 106 goes through the horizontal channel 114, which is a through-hole in the upper half 102 of the grip device 100.

Figure 5A:
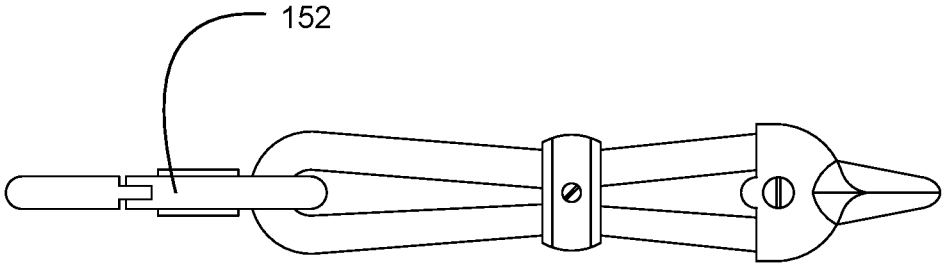
FIG. 5A illustrates a side view of a connection element with carabiner.
Figure 5B:
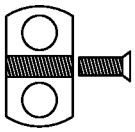
FIG. 5B illustrates a front view of a cable stop of the connection element.
Figure 5C:
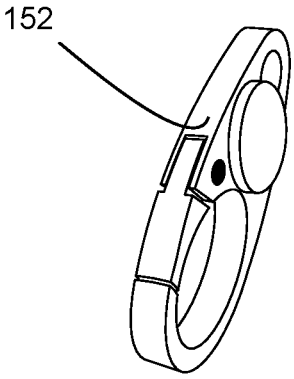
FIG. 5C illustrates a perspective view of the carabiner.

FIG. 5A illustrates a side view of a connection element with carabiner. FIG. 5B illustrates a front view of a cable stop of the connection element. FIG. 5C illustrates a perspective view of the carabiner.

Figure 6A:
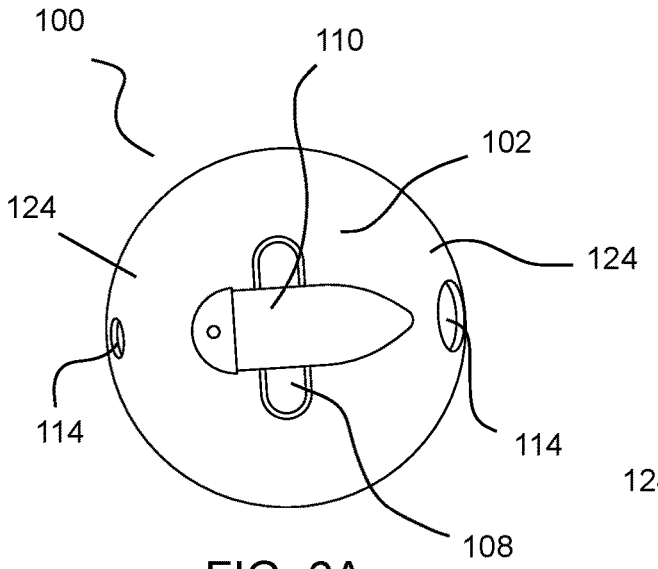
FIG. 6A illustrates is a top view of an exercise grip device.
Figure 6B:
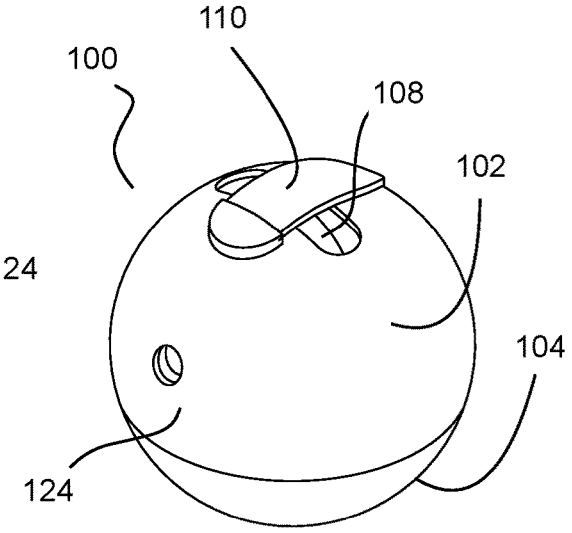
FIG. 6B illustrates an isometric top view of the exercise grip device of FIG. 6A.
Figure 6C:
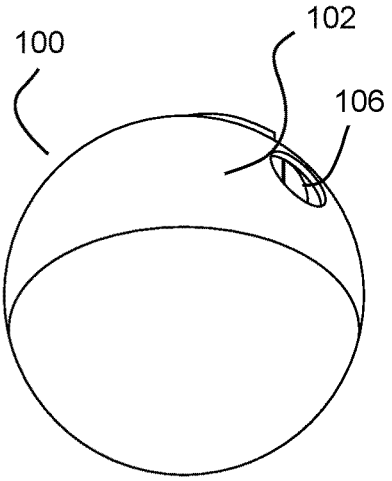
FIG. 6C illustrates an isometric bottom view of the exercise grip device of FIG. 6A.
Figure 6D:
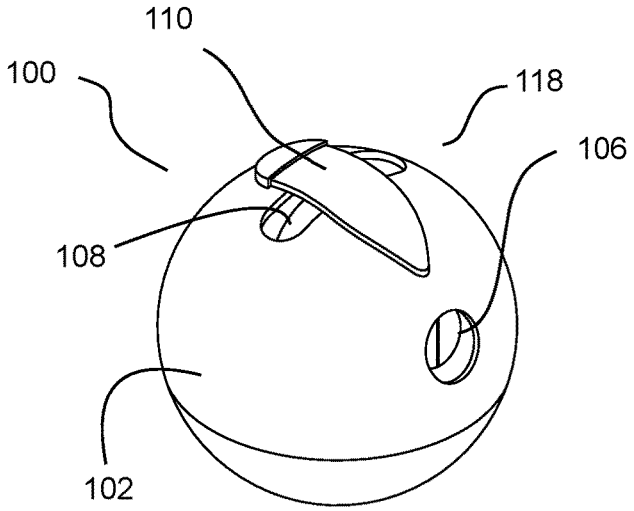
FIG. 6D illustrates an isometric top view of the exercise grip device of FIG. 6A.

FIG. 6A illustrates is a top view of an exercise grip device. FIG. 6B illustrates an isometric top view of the exercise grip device. FIG. 6C illustrates an isometric bottom view of the exercise grip device. FIG. 6D illustrates an isometric top view of the exercise grip device.

Figure 7A:
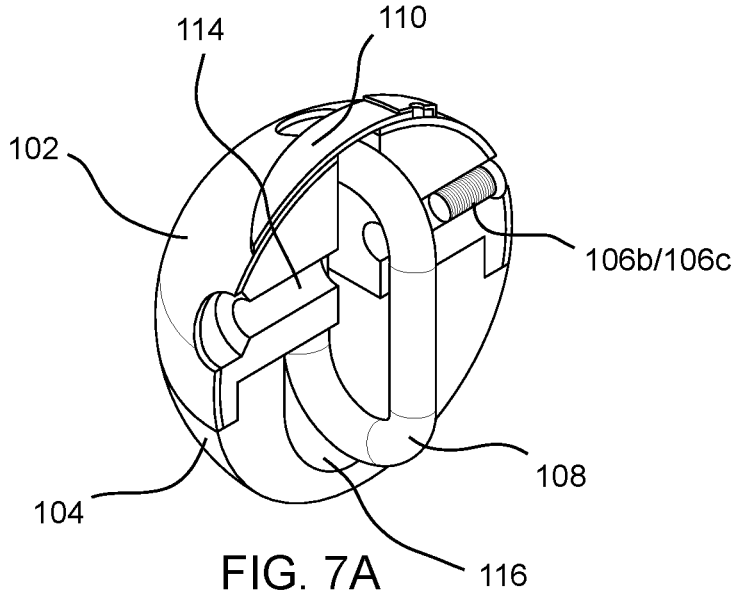
FIG. 7A illustrates an isometric cut-away view of the exercise grip device of FIG. 6A with small screw inserted.
Figure 7B:
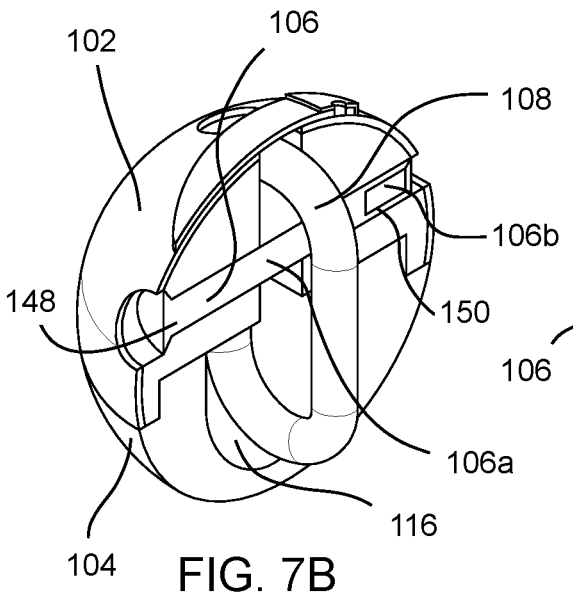
FIG. 7B illustrates an isometric cut-away view of the exercise grip device of FIG. 6A with entire pin inserted.
Figure 7C:
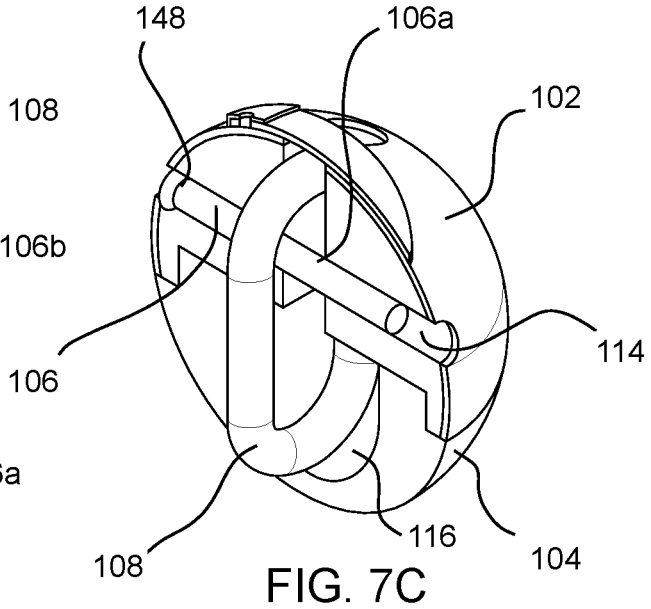
FIG. 7C illustrates an isometric cut-away view of the exercise grip device of FIG. 6A with the larger pin inserted.

FIG. 7A illustrates an isometric cut-away view of the exercise grip device of FIG. 6A with small screw inserted. FIG. 7B illustrates an isometric cut-away view of the exercise grip device with entire pin inserted. FIG. 7C illustrates an isometric cut-away view of the exercise grip device with the larger pin inserted.

Figure 8A:
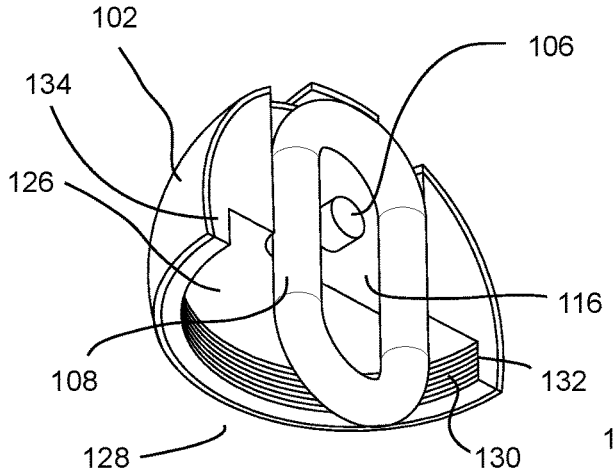
FIG. 8A illustrates an isometric cut-away view of the top portion of the exercise grip device of FIG. 6A.
Figure 8C:
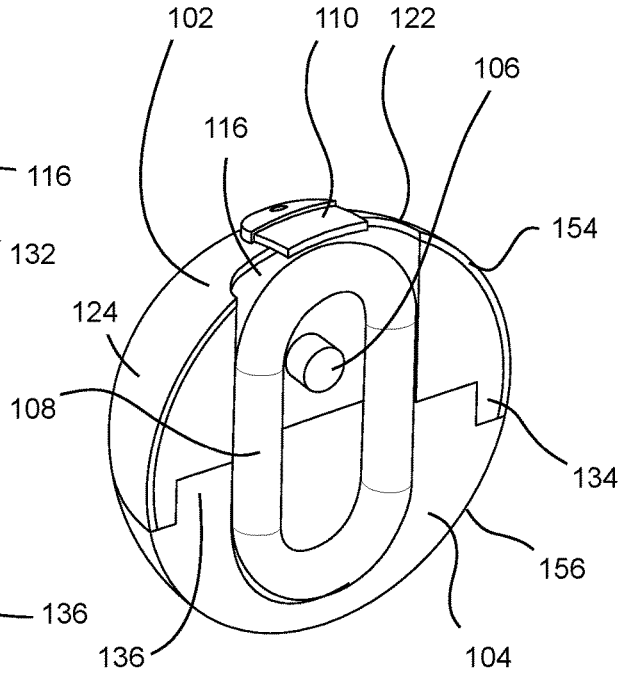
FIG. 8C illustrates an isometric cut-away view of the exercise grip device of FIG. 6A.
Figure 8B:
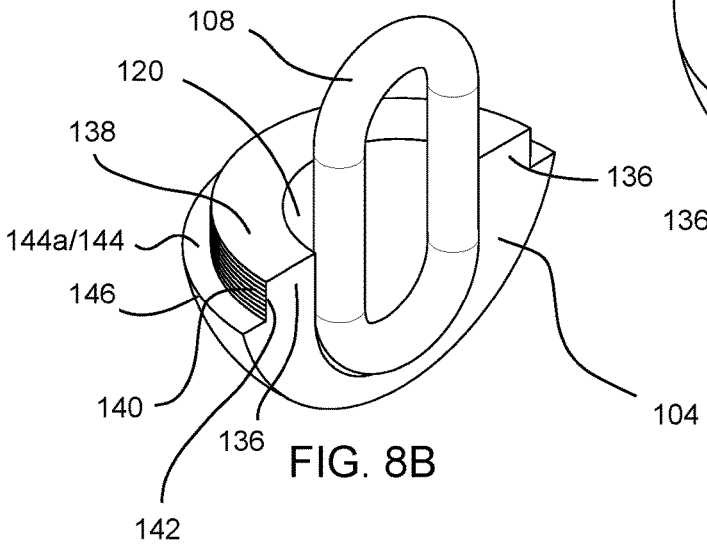
FIG. 8B illustrates an isometric cut-away view of the bottom portion of the exercise grip device of FIG. 6A.

FIG. 8A illustrates an isometric cut-away view of the top portion of the exercise grip device. FIG. 8B illustrates an isometric cut-away view of the bottom portion of the exercise grip device. FIG. 8C illustrates an isometric cut-away view of the exercise grip device.

Figure 9A:
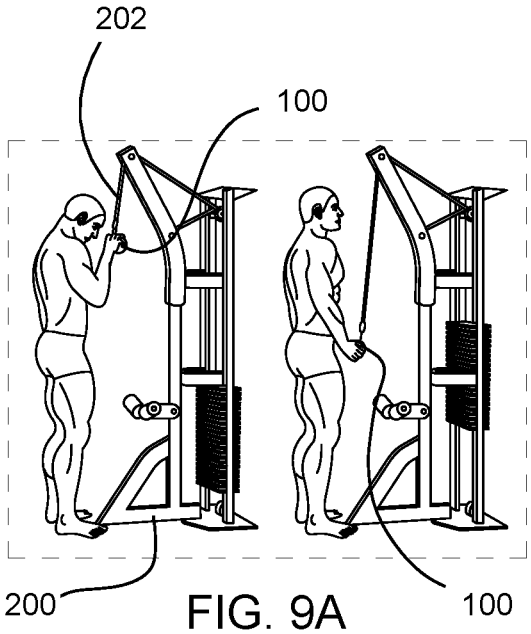
FIG. 9A illustrates a conceptual view of a user engaged with a cable machine with cords connecting to the ball grip.
Figure 9B:
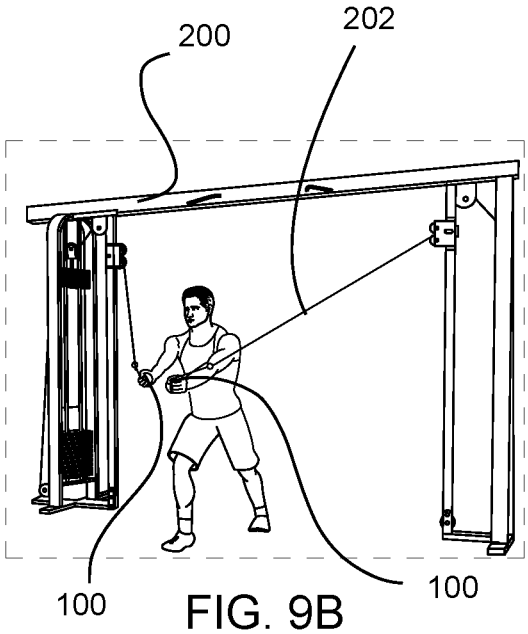
FIG. 9B illustrates a conceptual view of a user engaged with crossover cable equipment with cords connecting to the ball grip.
Figure 9C:
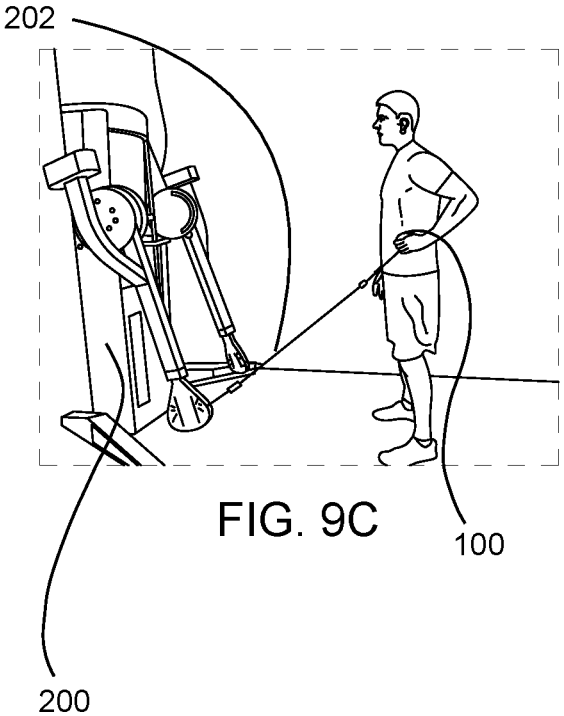
FIG. 9C illustrates a conceptual view of a user engaged with a cable machine with cords connecting to the ball grip.
Figure 9D:
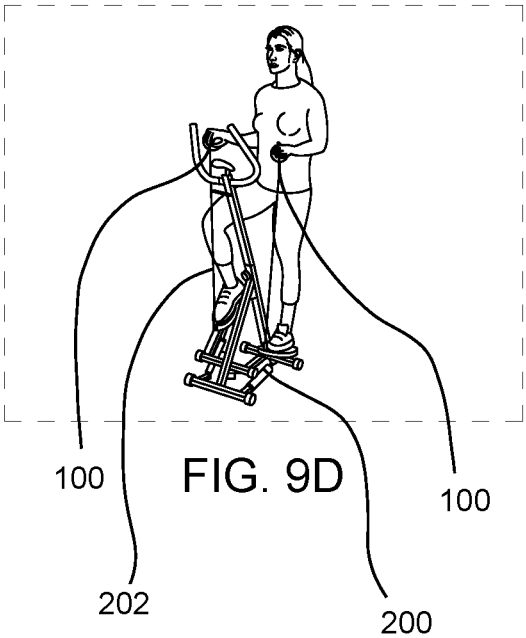
FIG. 9D illustrates a conceptual view of a user on a stepper with upper body cords connecting to the ball grip.

FIG. 9A illustrates a conceptual view of a user engaged with a cable machine with cords connecting to the ball grip. FIG. 9B illustrates a conceptual view of a user engaged with crossover cable equipment with cords connecting to the ball grip. FIG. 9C illustrates a conceptual view of a user engaged with a cable machine with cords connecting to the ball grip. FIG. 9D illustrates a conceptual view of a user on a stepper with upper body cords connecting to the ball grip.

In an exemplary embodiment, an exercise grip device 100 is provided. The exercise grip device 100 comprises a main body 118 formed from two detachable hemispheres 102/104, wherein the two detachable hemispheres comprise an upper hemisphere 102 and a lower hemisphere 104. The main body 118 generally forms a rounded shape. The grip device 100 also includes an internal cavity 120 in the main body 100 with an upper vertical channel 116 connecting the internal cavity 120 through the upper hemisphere 102 to an exterior area 122. As may be seen in FIGS. 7A-7C, a horizontal channel 114 is also present, recessing from an outer surface 124 of the upper hemisphere 102 to an opposite outer surface 124 of the upper hemisphere 102. The horizontal channel 114 extends through the upper hemisphere 102. A retaining ring 108 is included and removably disposed in the internal cavity 120, wherein the retaining ring 108 vertically extends upward in the upper vertical channel 116. The grip device 100 also includes a removable securement pin 106 extending through the horizontal channel 114 and through the retaining ring 108.

In some embodiments, as may be appreciated in FIGS. 8A-8B, the upper hemisphere 102 includes a circular recessed cavity 126 at a lower open area 128 with internal threading 130 on the circumferential interior side 132 of a sidewall 134 of the circular recessed cavity 126. The lower hemisphere 104 includes a cylindrical protrusion 136 at an upper area 138 with external threading 140 on sidewalls 142 of the cylindrical protrusion 136, and an offset 144 between an outer body wall 146 of the lower hemisphere 104 and the cylindrical protrusion 136 of a distance complemental to a depth of the sidewall 134 of the upper hemisphere 102. The cylindrical protrusion 136 have a geometry and dimensions complemental to the circular recessed cavity 126 of the upper hemisphere 102, whereby once engaged with the upper hemisphere 102 the cylindrical protrusion 136 recesses up into the circular recessed cavity 126 and the sidewalls 134 of the circular recess cavity 126 abut a top surface 144*a* of the offset 144, thereby forming a flush shape, as shown in FIG. 8C.

In some embodiments, as seen in FIGS. 7A-7C, the removable securement pin 106 comprises a two-part construction having a first part 106*a* and a second part 106*b*. The first part 106*a* defining a pin with a neck 148 at one end, and an open threaded cavity 150 at a distal end for receiving a second part 106*b* of the two-part securement pin. The second part 106*b* of the two-part securement pin defines a threaded screw 106*c* configured to rotatably recess into the open threaded cavity 150 of the first part 106*a* thereby forming a secured fitment whereby the pin 106 is no longer capable of sliding out of the horizontal channel 114.

In some embodiments, a carabiner 152 is included and clipped to the retaining ring 108, thereby connecting the retaining ring 108 to a cord 202 of an exercise equipment 200. In some embodiments, the system further includes a flap 110 traversing the upper vertical channel 116 at the exterior area 124 providing further containment for the retaining ring 108. In some embodiments, the rounded shape of the grip device forms a spherical body, as may be appreciated from the figures. In some embodiments, the main body 118 is configured to a size calibrated to fit into a hand of a user. In some embodiments, the upper hemisphere 102 includes an outer rubberized surface 154. In some embodiments, lower hemisphere 104 includes an outer rubberized surface 156.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. An exercise grip device, comprising:

a main body formed from two detachable hemispheres, wherein said two detachable hemispheres comprise an upper hemisphere and a lower hemisphere;

said main body forming a rounded shape;

an internal cavity in said main body with an upper vertical channel connecting said internal cavity through said upper hemisphere to an exterior area;

a horizontal channel recessing from an outer surface of said upper hemisphere to an opposite outer surface of said upper hemisphere, wherein said horizontal channel extends through said upper hemisphere;

a retaining ring removably disposed in said internal cavity, wherein said retaining ring vertically extends upward in said upper vertical channel; and a removable securement pin extending through said horizontal channel and through said retaining ring.

2. The exercise grip device, as recited in claim 1, further comprising:

said upper hemisphere including a circular recessed cavity at a lower open area with internal threading on the circumferential interior side of a sidewall of said circular recessed cavity;

said lower hemisphere including a cylindrical protrusion at an upper area with external threading on sidewalls of said cylindrical protrusion, and an offset between an outer body wall of said lower hemisphere and said cylindrical protrusion a distance complemental to a depth of said sidewall of said upper hemisphere; and said cylindrical protrusion having a geometry and dimensions complemental to said circular recessed cavity of said upper hemisphere, whereby once engaged with said upper hemisphere said cylindrical protrusion recesses up into said circular recessed cavity and said sidewalls of said circular recess cavity abut a top surface of said offset, thereby forming a flush shape.

3. The exercise grip device, as recited in claim 1, wherein:

said removable securement pin comprises a two-part construction having a first part and a second part;

said first part defining a pin with a neck at one end, and an open threaded cavity at a distal end for receiving a second part of said two-part securement pin; and said second part of said two-part securement pin defines a threaded screw configured to rotatably recess into said open threaded cavity of said first part thereby forming a secured fitment whereby said pin is no longer capable of sliding out of said horizontal channel.

4. The exercise grip device, as recited in claim 1, further comprising:

a carabiner clipped to said retaining ring, thereby connecting said retaining ring to a cord of an exercise equipment.

5. The exercise grip device, as recited in claim 1, further comprising:

a flap traversing said upper vertical channel at said exterior area providing further containment for said retaining ring.

6. The exercise grip device, as recited in claim 1, wherein said rounded shape forms a spherical body.

7. The exercise grip device, as recited in claim 1, wherein said main body is configured to a size calibrated to fit into a hand of a user.

8. The exercise grip device, as recited in claim 1, wherein said upper hemisphere includes an outer rubberized surface.

9. The exercise grip device, as recited in claim 1, wherein said lower hemisphere includes an outer rubberized surface.

* * * * *